United States Patent [19]

Van Gennep

[11] Patent Number: 4,920,832

[45] Date of Patent: May 1, 1990

[54] TOOL DRIVER

[76] Inventor: Jan Van Gennep, 715 Laurel Ave., Menlo Park, Calif. 94025

[21] Appl. No.: 274,925

[22] Filed: Nov. 22, 1988

[51] Int. Cl.[5] ..... B25B 17/00

[52] U.S. Cl. ..... 81/57.29; 81/58.1

[58] Field of Search ..... 81/57.29, 58.1

[56] References Cited

U.S. PATENT DOCUMENTS 1,299,491 4/1919 Malchow ..... 81/57.29
2,696,859 12/1954 Somma ..... 81/57.29
3,532,012 10/1970 Pryor ..... 81/57.29
4,455,896 6/1984 Holmes ..... 81/57.29 X

*Primary Examiner*—James G. Smith
*Attorney, Agent, or Firm*—Flehr, Hohbach, Test, Albritton & Herbert

[57] ABSTRACT

A method and apparatus for tightening and loosening fasteners located in hard-to-reach locations, wherein either a direct driving means or an indirect driving means can be used to rotate the fastener into position. The indirect means is used to convert the direction of motion to drive the direct driving means.

5 Claims, 3 Drawing Sheets

TOOL DRIVER

BACKGROUND OF THE INVENTION

This invention relates to a device for driving and unfastening mechanical fasteners. More particularly, this invention relates to a driving and unfastening device designed to facilitate the tightening and loosening of fasteners in hard-to-reach locations.

Fasteners located in hard-to-reach locations are typically tightened or loosened using either a universal joint, or using a mechanic's hands for the lack of a special tool. A universal-type driver utilizing a universal joint is known in the art for allowing some play in the angle. However, this joint can only be used in applications with relatively shallow angles since rotating the joint at any angle, even approaching 90°, will result in the corresponding rotation of the full universal-type driver. The problem with such full rotation is that a large amount of space is required for such full rotation. A universal joint also tends to slip off a fastener due to the inability to operate the universal-type driver at sharp angles. All these disadvantages make a universal joint somewhat awkward and inefficient to operate.

Often a mechanic's bare hands will be used for tightening and loosening fasteners. However, hands tend to obstruct the movement of the fastener. Also, the desired tightness of a fastener is often unobtainable with bare hands. Conversely, a tight fastener often cannot be loosened with bare hands. As a result, using hands to tighten or loosen fasteners can be awkward and inefficient. For example, if a mechanic is required to contort his/her hands into an engine compartment to tighten a nut, the mechanic may quickly become frustrated by not being able to adequately reach the nut, much less being able to tighten it.

SUMMARY OF THE INVENTION

In order to overcome the above-discussed disadvantages, the present invention provides a device for tightening and loosening fasteners which is capable of being operated in hard-to-reach locations. This invention also provides a tool driving device which is safe, efficient and easy to use.

To provide this useful and efficient device, a tool driver includes a direct driving means and an indirect driving means. Preferably, the direct driving means is and extension which includes a ratchet connector end and a socket connector end. The socket connector end is adapted to receive a socket to tighten or loosen a fastener. A ratchet or the like, when placed in the wrench connector end, is used to drive a fastener.

The indirect driving means includes a bevel gear assembly positioned along a different axis from the socket extension of the direct driving means. The bevel gear assembly of the indirect driving assembly is positioned to mesh with a bevel gear assembly which is integral with the socket extension of the direct driving means. When rotated, the indirect driving means converts the direction of motion to drive the direct driving means. Since the indirect driving means is located on a different axis from the direct driving means, the tool can be operated from different angles.

In operation, the direct driving means is preferred for applying the required threshold torque when tightening a fastener and for "breaking" the applied threshold torque when loosening a fastener. The indirect driving means is preferred for rotating a fastener without needing to apply or "break" a threshold torque. In the preferred arrangement, both the direct driving means and the indirect driving means can be used with a socket wrench, another wrench or the like to rotate the socket connector and the socket extension. Additional socket extensions may also be used to aid in tightening or loosening a fastener. Alternately, a small, inexpensive motor configuration could be used, to allow motorized turning of the loosened fastener.

The tool driver is also very safe to use. Both bevel gear assemblies are enclosed in a housing so as not to catch the hands of the mechanic using the tool driver. If desired, the device can be safely held against the fastener to be tightened or loosened without the possibility of pinching the user's fingers in the gears.

BRIEF DESCRIPTION OF THE DRAWINGS

An exemplary and presently preferred embodiment of the invention will be described in detail with reference to the accompanying drawings in which.

DETAILED DESCRIPTION OF THE PREFERRED EMBODIMENT

Figure 1:
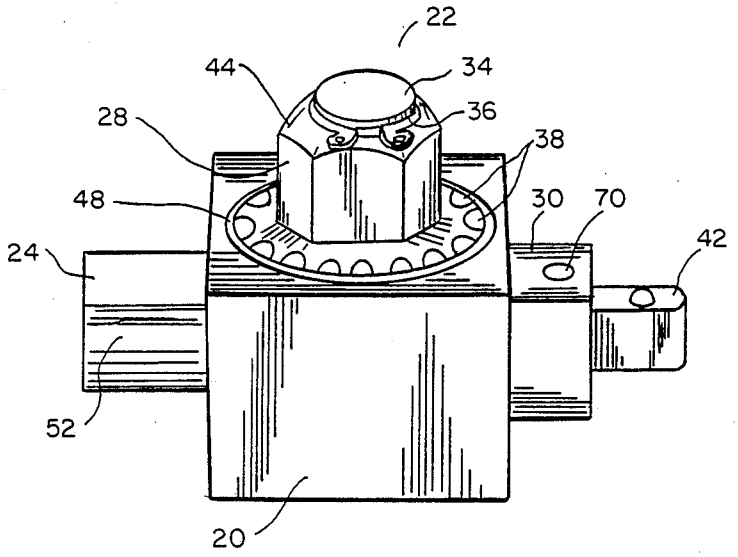
FIG. 1 is a perspective view illustrating a tool driver of the embodiment of the present invention.
Figure 2:
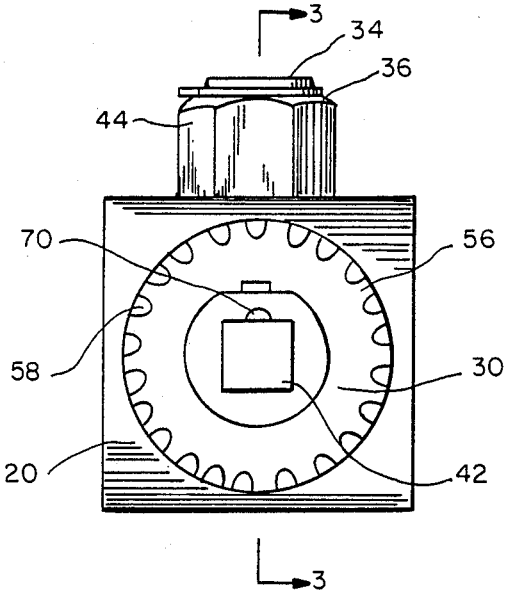
FIG. 2 is a side view illustrating the tool driver shown in FIG. 1.
Figure 3:
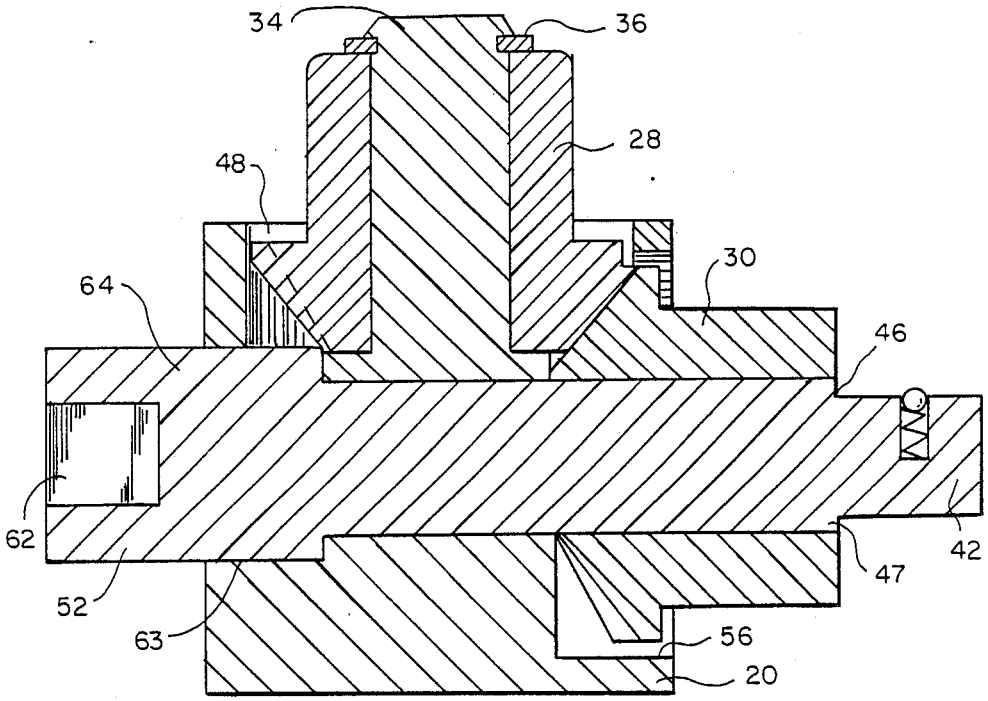
FIG. 3 is a cross-sectional view of the tool driver in FIG. 2.

Referring to the accompanying drawings, FIGS. 1 and 2 show a preferred embodiment of the tool driver. A housing 20 encloses an indirect driving portion 22 and a direct driving portion 24. The direct driving portion 24 includes a socket extension 52 extending through the housing 20, which is integral with first bevel gear assembly 30. The socket extension 52 includes a ratchet drive receiving end 62, adapted to connect to a socket tightening wrench as shown in FIG. 3, and a socket connector end 42, adapted to receive a socket to tighten/loosen the desired nut. Connector 42 is disposed outside of the housing 20 and outside of the bevel gear assembly 30.

The indirect driving portion 22 includes a second bevel gear assembly 28 rotatably positioned on a shaft 34, where the shaft 34 is fixed within the housing 20. The second bevel gear 28 is held onto the shaft 34 by the clip 36. The second bevel gear assembly 28 includes an integral driving nut 44 which is of a size adapted to be used with a socket wrench, another type of wrench or the like to rotate the second bevel gear assembly 28.

The first bevel gear assembly 30 is positioned in a first enlarged bore 56, while the second bevel gear assembly 28 is positioned in a second enlarged bore 48. Both bevel gear assemblies 28 and 30 are positioned in the housing 20 such that the teeth 58 of the first bevel gear assembly 30 mesh with the teeth 38 of the second bevel gear assembly 28. Thus, when the second bevel gear assembly 28 is rotated, the first bevel gear assembly 30 will also rotate and vice versa.

The arrangement of the bevel gear assemblies allows either the direct driving portion 24 or the indirect driving portion 22 to be utilized for rotating socket connector 42. Either the direct driving portion can be used to directly turn the connector 42, or the indirect driving portion can be used to convert the direction of motion and to turn the connector 42. An inexpensive battery-controlled motor could also be used to drive the indirect driving portion, to automate this feature.

The positioning and structure of the bevel gear assemblies 28 and 30 also provide a safety feature for this invention. The gear assemblies 28 and 30 are beveled gears, therefore safeguarding the teeth from catching a user's hand. As further protection, the assemblies are enclosed in the housing 20 to further safeguard the hand of the holder from the meshing of the teeth of the gears in order to prevent pinching or other injury.

Figure 4:
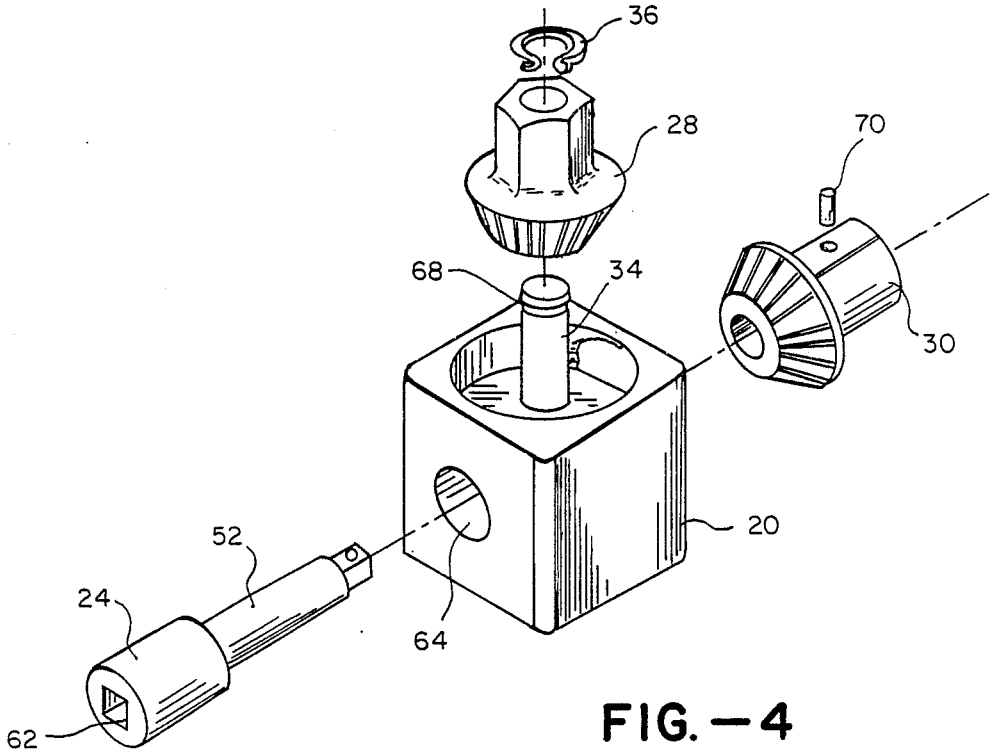
FIG. 4 is an exploded view of the embodiment of the invention.

FIG. 3 is a cross-sectional view of the present invention. The shaft 34 is fixed in the housing 20. A cylindrical hole 64, located beneath the shaft 34, extends fully through the housing 20. On one side of the cylindrical hole 64 is the first enlarged bore 56, which is made deep enough so that the first bevel gear assembly 30 can be secured within the housing 20. The other end of the cylindrical hole 64 includes a smaller bore 63 which is large enough to enclose the receiving connector end 62 of the extension 52. The entire extension 52 is then positioned through the block and press-fit onto the first bevel gear assembly 30, such that the socket connector 42 fully extends outside of the bevel gear assembly 30. For a press-fit, the flat sides 47 of the socket extension 52 engage with the complementary flat surfaces of the gear collar 46. The socket extension 52 can also be secured through the use of a set screw 70 as is illustrated in FIGS. 1, 2 and 4, to secure the socket extension 52 to the bevel gear assembly 30. Although a set screw is illustrated, a press-fit is preferred.

A second enlarged bore 48 is made deep enough to enclose the second bevel gear assembly 28, where the second bevel gear assembly 28 is rotatably positioned on the shaft 34 with the use of the clip 36. When either the connector receiving end 62 or the second bevel gear assembly 28 is rotated, the first bevel gear assembly 30 rotates along with the entire socket extension 52. As a result, the socket connector 42 can be used to drive fasteners through the use of either the direct driving portion 24 or the indirect driving portion 22.

FIG. 4 shows an exploded view of one embodiment of the present invention. In this embodiment, a set screw 70 is used to secure the first bevel gear assembly 30 to the shaft extension 52 (although a press-fit is required). Additionally, a slot 68 is used with the clip 36 to secure the second bevel gear assembly 28 in position.

In operation, either the direct driving portion 24 or the indirect driving portion 22 can be used to tighten or loosen a fastener. When using either means, the socket connector 42, which is adapted to receive a socket, acts as a driving end to tighten or loosen the desired fastener. Such a socket would then be positioned over a fastener for operation. To use the direct driving portion, a ratchet or similar wrench is positioned perpendicularly to the desired fastener and connected to wrench connector end 62 of the socket extension 52. The wrench is then rotated to directly tighten or loosen the fastener, providing a maximal torque to "break" or tighten the fastener. To use the indirect driving portion 22, a socket wrench and/or a socket is positioned over the integral driving nut 44. The socket wrench is rotated to turn the second bevel gear assembly 28. This motion rotates first gear assembly 30 and correspondingly rotates socket connector 42. The socket on connector 42 is therefore also rotated to tighten or loosen the fastener. When using the indirect driving portion 22, the direction of motion is therefore converted by means of the meshing bevel gear assemblies 28 and 30.

In operation, typically when removing a fastener, a user will first break the threshold torque applied to the tightened fastener by using a socket wrench and the socket extension 52 to initially loosen the fastener. The fastener can then be further loosened by use of a socket wrench and an extension, if necessary, using either the direct driving portion 24 or the indirect driving portion 22. Note that it is preferable to use the direct driving portion 24 initially in order to "break" the threshold torque. Thereafter, the most convenient means can be used to fully loosen the fastener. To this end, the bevel gear assemblies may have a gear ratio different than 1:1. Since the torque when using the indirect driving portion 22 would be expected to be small, the nut could be more quickly loosened and/or tightened in this way.

When tightening a fastener, a user will typically use the indirect driving portion of the invention to initially secure the fastener. In order to apply the necessary threshold torque to fully tighten the fastener, the direct drive extension should be used.

The use of this invention obviates the necessity of manipulation at the location of the fastener, other than the initial "breaking" or the final tightening.

Figure 5:
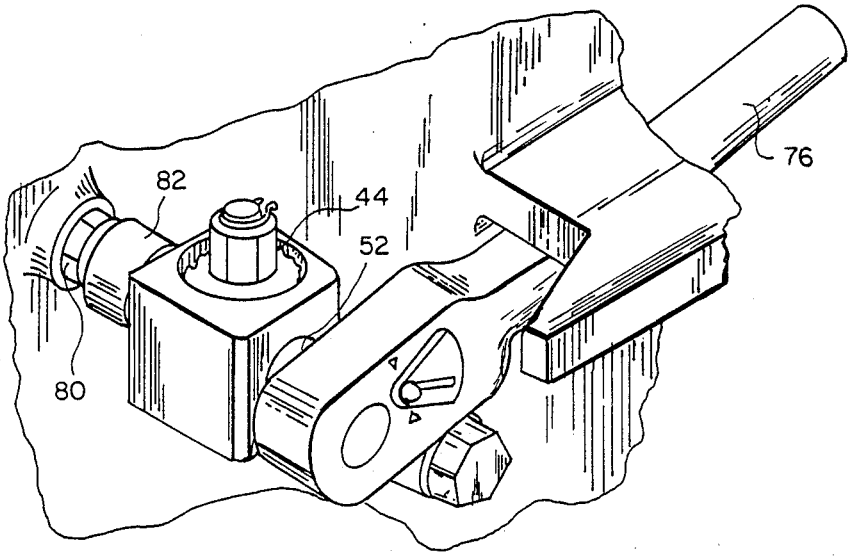
FIG. 5 is a perspective view showing one application of the present invention.
Figure 6:
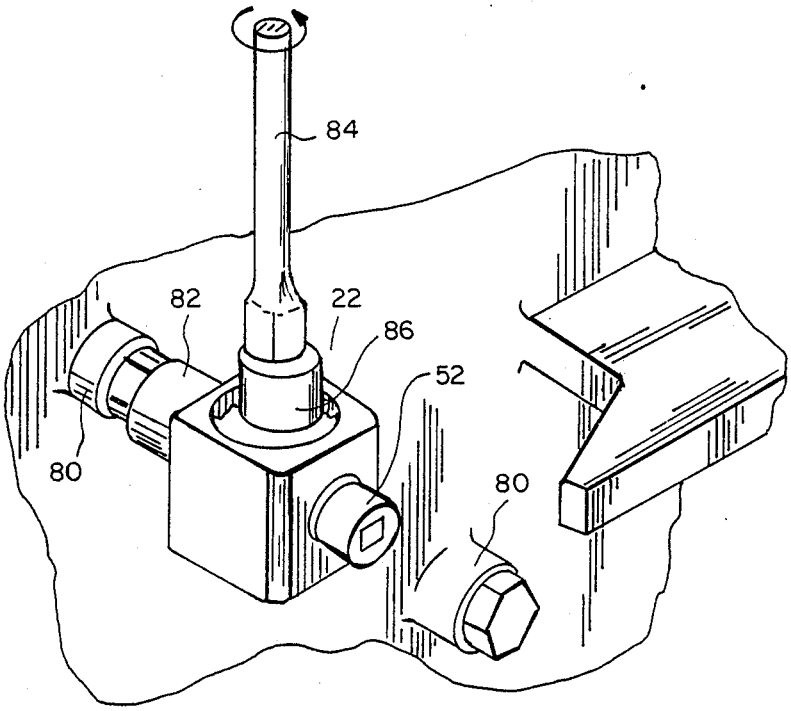
FIG. 6 is a perspective view showing a second application of the invention.

FIGS. 5 and 6 illustrate two possible applications of the tool driver. In FIG. 5, a fastener 80 is being directly driven by the ratchet 76. To operate, a socket 82 is placed over the fastener 80, where the socket 82 is attached to the socket connector end 42 of the extension 52. By placing the ratchet wrench 76 into the receiving connector end 62 of the ratchet extension 52, the socket wrench 76 can be rotated to either tighten or loosen the fastener 80.

When the fastener to be tightened or loosened is located in a hard-to-reach location and cannot be directly driven, as in FIG. 5, FIG. 6 demonstrates a different way to tighten or loosen the fastener 80. In this case, the indirect driving portion 22 is being utilized to tighten or loosen the fastener 80. Once again, as in FIG. 5, a socket 82 is placed over the fastener 80, where the socket 82 is connected to the socket connector 42. A socket 86 is also placed over the integral driving nut 44 of the indirect driving portion 22. Either a ratchet wrench or the like can be directly placed on the socket 86 or an extension 84 can be used with the wrench to drive the fastener 80.

The invention is versatile in its ability to be manipulated. As well as being able to operate the tool from either the direct driving portion 24 or the indirect driving portion 22, the housing 20 and the indirect driving portion 22 can be rotated 360 degrees relative to the socket connector 42. This gives the present invention even more flexibility when choosing how to position it and at what angle to operate an accompanying socket wrench or the like.

The tool driver can be used to drive various types of fasteners. The invention can be used to tighten or loosen nuts, bolts, fasteners, screws, and the like. In other words, the tool driver can be employed in any application in which a device is to be driven or rotated.

While the drawings illustrate an embodiment of the invention where the direct driving portion and the indirect portion are perpendicular, the indirect driving portion can be placed at almost any angle from the direct driving portion. Also, different sizes of socket extensions and different sizes of socket arrangements may be used with the invention. Additionally, the tool driver is not limited to use with sockets. Rather, it can be appropriately designed to be an intermediate between any body to be driven and the driver.

Although only a few exemplary embodiments of this invention have been described in detail above, those skilled in the art will readily appreciate that many modifications are possible in the exemplary embodiments without materially departing from the novel teachings and advantages of this invention.

Accordingly, all such modifications are intended to be included within the scope of this invention as defined in the following claims.

What is claimed is:

1. A device for tightening and loosening fasteners, comprising:

a housing formed with inner surfaces that define a cylindrical hole extending completely through said housing between first and second surfaces thereof, said hole having a first smaller diameter portion at said first surface, and a second larger diameter portion at said second surface, and said housing formed with surfaces that define an enlarged bore located on a third surface;

a first bevel gear assembly, rotatably positioned in said second larger diameter portion of said cylindrical hole, and having teeth which are recessed below said second surface;

direct driving means, extending through said cylindrical hole and integrally coupled to said first bevel gear assembly, said direct driving means including a tool connector at a first area thereof, adapted for the receipt of a tool to tighten or loosen a fastener, and a tool driver connector at a second area thereof to directly drive said tool; and indirect driving means, including a second bevel gear assembly rotatably coupled to said enlarged bore, and having teeth which are recessed below said third surface, said teeth, integrally meshing with said teeth of said first bevel gear assembly, such that rotating said second bevel gear assembly causes said first bevel gear assembly and said direct driving means to rotate, said second bevel gear assembly including means for receiving a tool driver adapted to rotate said second bevel gear assembly to indirectly drive said tool.

2. A device for tightening and loosening fasteners as recited in claim 1, further comprising a shaft fixedly positioned to said housing at an area thereof and extending outward from said enlarged bore on which said indirect driving means is mounted, and means for holding said second bevel gear assembly on said shaft.

3. A device for tightening and loosening fasteners as recited in claim 1, further comprising a socket wrench disposed in said wrench receiving connector to directly drive said first bevel gear assembly and said direct driving means.

4. A device for tightening and loosening fasteners as recited in claim 2, wherein said means for receiving a tool adapted to rotate said indirect driving means is an integral driving nut and, further comprising;

a tool disposed over said integral driving nut; and a tool wrench connected in said tool so that rotating said tool wrench directly rotates said second bevel gear assembly and indirectly rotates said first bevel gear assembly and said direct driving means.

5. A device for tightening and loosening fasteners, as recited in claim 2, wherein said means for holding said second bevel gear assembly is a clip.

* * * * *